United States Patent [19]

Lee et al.

[11] Patent Number: 4,895,783

[45] Date of Patent: Jan. 23, 1990

[54] OVERCOATED ELECTROPHOTOGRAPHIC PHOTORECEPTOR CONTAINS METAL ACETYL ACETONATE IN POLYMER LAYER

[75] Inventors: Lieng-Huang Lee, Webster; Christine J. Tarnawskyj, Rochester, both of N.Y.

[73] Assignee: Xerox Corporation, Stamford, Conn.

[21] Appl. No.: 293,025

[22] Filed: Jan. 3, 1989

[51] Int. Cl.[4] ..... G03G 5/14

[52] U.S. Cl. ..... 430/66; 430/57

[58] Field of Search ..... 430/66, 67, 57

[56] References Cited

U.S. PATENT DOCUMENTS

| | | | |
|---|---|---|---|
| 4,444,862 | 4/1984 | Yagi et al. | 430/67 |
| 4,606,934 | 8/1986 | Lee et al. | 427/76 |

FOREIGN PATENT DOCUMENTS

| | | |
|---|---|---|
| 8018637 | 2/1983 | Japan . |
| 9046651A | 3/1984 | Japan . |
| 9046653A | 3/1984 | Japan . |
| 2106659A | 4/1983 | United Kingdom . |

*Primary Examiner*—J. David Welsh

[57] ABSTRACT

An electrophotographic imaging member comprising a supporting substrate, at least one photoconductive layer and an overcoating layer having one side contiguous with the electrophotographic imaging layer and the other side exposed to the ambient atmosphere, the overcoating layer comprising a solid solution or molecular dispersion of a metal acetyl acetonate in an insulating film forming polymer.

13 Claims, No Drawings

OVERCOATED ELECTROPHOTOGRAPHIC PHOTORECEPTOR CONTAINS METAL ACETYL ACETONATE IN POLYMER LAYER

BACKGROUND OF THE INVENTION

This invention relates to overcoated electrophotographic imaging members and more particularly, to electrophotographic imaging members overcoated with a metal acetyl acetonate in an insulating film forming polymer.

The formation and development of electrostatic latent images utilizing electrophotographic imaging members is well known. One of the most widely used processes being xerography as described by Carlson in U.S. Pat. No. 2,297,691. In this process, an electrostatic latent image formed on an electrophotographic imaging member is developed by applying electropscopic toner particles thereto to form a visible toner image corresponding to the electrostatic latent image. Development may be effected by numerous known techniques including cascade development, powder cloud development, magnetic brush development, liquid development and the like. The deposited toner image is normally transferred to a receiving member such as paper.

Electrophotographic imaging systems may utilize single multilayered organic or inorganic photoresponsive devices. In one photoresponsive device, a substrate is overcoated with a hole injecting layer and a hole transport layer. These devices have been found to be very useful in imaging systems. The details of this type of overcoated photoreceptor are fully disclosed, for example, in U.S. Pat. No. 4,265,990. The entire disclosure of this patent is incorporated herein by reference. If desired, multilayered photoresponsive devices may be overcoated with a protective layer. Other photoreceptors that may utilize protective overcoatings include inorganic photoreceptors such as the selenium alloy photoreceptors, disclosed in U.S. Pat. No. 3,312,548, the entire disclosure of which is incorporated herein by reference.

When utilizing such an organic or inorganic photoresponsive device in different imaging systems, various environmental conditions detrimental to the performance and life of the photoreceptor from both a physical and chemical contamination viewpoint can be encountered. For example, organic amines, mercury vapor, human fingerprints, high temperatures and the like can cause crystallization of amorphous selenium photoreceptors thereby resulting in undesirable copy quality and image deletion. Further, physical damage such as scratches on both organic and inorganic photoresponsive devices can result in unwanted printout on the final copy. In addition, organic photoresponsive devices sensitive to oxidation amplified by electric charging devices can experience reduced useful life in a machine environment.

Photoreceptors overcoated with insulating polymers tend to exhibit a build-up in residual potential during cycling because all of the charges initially deposited during uniform charging cannot not be fully dissipated upon exposure to light. This phenomenon is manifested by an increase in background deposits in the final xerographic copy. Thus, abrasion-resistant and transparent polymers such as polycarbonates, polyesters, polymethacrylates, polysulfones, polyarylates, polyimides, etc. are generally too highly resistive for use in overcoats for photoreceptors that are cycled. Attempts have been made to add other materials to address the residual potential problem. Unfortunately, properties, such as transparency, of the overcoating layer may be adversely affected by the addition of such added material. More specifically, the transparency of an overcoating layer may become translucent or even opaque. Further, some additives detract from the mechanical properties of an overcoating and affect, for example, adhesion between the overcoating and the underlying layer.

Conductive additives have been incorporated into overcoating layers to reduce residual potential build up during cycling. However, some additives such as ammonium salts tend to increase lateral conductivity, particularly under ambient high humidity conditions. Lateral conductivity can cause blurring of the edges of the image or even total loss of the image in the final copy.

An overcoating layer is described in U.K. No. 2,106,659. This overcoating layer requires the use of a blocking layer. The requirement of an additional coating step complicates the fabrication of the photoreceptor, can cause delamination, increases residual potential, and reduces sensitivity.

INFORMATION DISCLOSURE STATEMENT

In U.K. No. 2,106,659 Ohmi et al published on Apr. 13, 1983—An electrophotographic photosensitive material comprising a conductive support base, a photoconductive layer, an interlayer comprising an organic metal compound as its main component, and a low-resistance protective layer. The organometallic compound may be a metal acetyl acetonate, e.g. see page 2, lines 2-24.

In U.S. Pat. No. 4,444,862 issued to Yagi et al on Apr. 24, 1984—An electrophotographic photosensitive material comprising a conductive support base, a photoconductive layer, an interlayer comprising an organic metal compound as its main component, and a low-resistance protective layer. This patent appears to be the corresponding U.S. equivalent of U.K. No. 2,106,659.

In Japanese Patent Document No. 59-46651 to Tachigi et al, published on Mar. 16, 1984—A photoreceptor for electrophotography is disclosed comprising a conductive layer, a charge generation layer containing an organic pigment for generating charge, a charge transport layer and a protective layer, the protective layer comprising a resin and at least one organometallic compound selected from the group consisting of alkoxide, aryloxide, acylate, chelate, and their hybrid compounds of a transition metal or aluminum. Ethylacetoacetate aluminum diisopropylate is as organic metal compound used in Examples 1 and 4.

In Japanese Patent Document No. 59-46651 to Hitachi, published on Mar. 16, 1984—A photosensitive material for electrophotography is disclosed comprising a conductive layer, a charge generation layer containing an organic pigment for generating charge, a charge transport layer and a protective layer, the protective layer comprising at least one organometallic compound selected from the group consisting of alkoxide, allyloxide, acylate, chelate, and their mixtures of transition metals and aluminum. Ethylacetoacetate aluminum diisopropylate is as organic metal compound used in Examples 1 and 4.

In Japanese Patent Document No. 58-18637 to Fuji Xerox, published on Feb. 3, 1083—An electrophotographic photoreceptor is disclosed comprising a photoconductive layer, an interlayer and a protective layer, the interlayer containing at least one organic titanium compound. The organic titanium compound is preferably a titanium ortho-ester, a polyorthotitanic acid or a titanium chelate. Diisopropoxytitanium bis(acetylacetonate) is specifically disclosed.

In U.S. Pat. No. 4,606,934 issued to Lee et al. on Aug. 19, 1986, A process for forming an overcoated electrophotographic imaging member is disclosed comprising applying on an electrophotographic imaging member a coating in liquid form comprising a cross-linkable siloxanolcolloidal silica hybrid material having at least one silicon bonded hydroxyl group per every three —SiO— units and a catalyst for the cross-linkable siloxanol-colloidal silica hybrid material, the coating in liquid form having an acid number of less than about 1 and curing the coating on the electrophotographic imaging member imaging member and a hydrolyzed ammonium salt of an alkoxy silane and curing the cross-linkable siloxanolcolloidal silica hybrid material until the siloxanolcolloidal silica hybrid material until it forms a hard cross-linked solid organosiloxane-silica hybrid polymer layer.

When highly electrically insulating protective overcoatings are used on photoreceptors, the thickness of the overcoatings are limited to extremely thin layers due to the undesirable residual voltage cycle up. Thin overcoatings provide less protection against abrasion and therefore fail to extend photoreceptor life for any significant period. Conductive overcoatings components permit thicker coatings but can cause fluctuations in electrical properties with change in ambient humidity and also contribute to lateral conduction with a resulting reduction in image resolution. Moreover, under cycling conditions over an extended period of time at elevated temperatures and high relative humidity, such silicone overcoated photoreceptors containing a conductive overcoating component can cause deletions in the images of final copies.

SUMMARY OF THE INVENTION

It is a feature of the present invention to provide improved overcoated electrophotographic imaging members which overcome many of the above noted disadvantages.

A further feature of the present invention is to provide an overcoating for electrophotographic imaging members which does not degrade images under cycling conditions over an extended period of time at low or elevated temperatures.

It is another feature of the present invention to provide a cured silicone overcoating for electrophotographic imaging members which does not degrade images under cycling conditions over an extended period of time at low or high relative humidity.

It is further feature of the present invention to provide an overcoating which controls residual voltage build up and any resulting print background during cycling.

It is further feature of the present invention to provide an overcoating which controls lateral conductivity under ambient high humidity conditions.

It is still a further feature of the present invention to provide an overcoating which can be substantially transparent or translucent.

It is still a further feature of the present invention to provide an overcoating which improves adhesion between the overcoating and the underlying layer.

It is another feature of the present invention to provide an overcoating which extends the useful life of electrophotographic imaging members.

These and other features of the present invention are accomplished by providing an electrophotographic imaging member comprising a supporting substrate, at least one photoconductive layer and an overcoating layer having one side contiguous with the electrophotographic imaging layer and the other side exposed to the ambient atmosphere, the overcoating layer comprising a solid solution or molecular dispersion of a metal acetyl acetonate in an insulating film forming polymer.

Any suitable metal acetyl acetonate may be employed. The expression "metal acetyl acetonate" is defined as the metal chelate 2,4-pentanedione. The metal acetyl acetonate may be represented by the following formula:

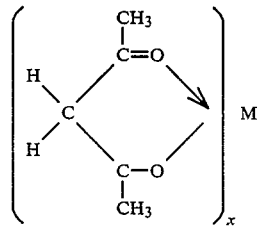

wherein M is a metal ion selected from the group consisting of aluminum, magnesium, zirconium, titanium, zinc, calcium, barium, strontium, scandium, yttrium, lanthanum, vanadium, niobium, cadmium, tin and silver and wherein x is the valence of the metal ion.

Typical specific metal acetyl acetonates include zirconium bis(acetyl acetonate), aluminum tris(acetyl acetonate), magnesium bis(acetyl acetonate), calcium bis(acetyl acetonate), barium bis(acetyl acetonate), strontium bis(acetyl acetonate), cadmium bis(acetyl acetonate), silver (acetyl acetonate), titanium tetra(acetyl acetonate), scandium tri(acetyl acetonate), nickel tri(acetyl acetonate), tin tetra(acetyl acetonate), yttrium tri(acetonate), and the like. Preferably, the metal acetyl acetonate has a white color is colorless prior to incorporating the metal acetyl acetonate into the coating mixture. White or colorless metal acetyl acetonates maintain the transparency or translucence of the film forming polymer employed. If desired, mixtures of metal acetyl acetonates may be employed to form the overcoating of this invention. Zirconium bis(acetyl acetonate) and aluminum tris(acetyl acetonate) are preferred because overcoatings formed therefrom are transparent.

The metal acetyl acetonate component of the overcoating mixture is present in film forming polymer as a solid solution or as a molecular dispersion. A solid solution is defined as a composition in which at least one component is dissolved in another component and which exists as a homogeneous solid phase. A molecular dispersion is defined as a composition in which particles of at least one component are dispersed in another component, the dispersion of the particles being on a molecular scale. Generally, satisfactory results may be achieved when between about 5 percent by weight and about 50 percent by weight metal acetyl acetonate, based on the total weight of the layer, is employed in the overcoating layer. As the concentration of the metal acetyl acetonate increases above about 50 percent by weight, the background toner deposits tends to increase. Optimum results are achieved with the weight ratio of metal acetyl acetonate to insulating polymer of about 1:1. When additives such as charge transport materials are introduced into the overcoating layer of this invention, less metal acetyl acetonate may be utilized. A satisfactory range of charge transport materials in the overcoating is between about 0.01 percent by weight and about 10 percent by weight of the charge transport material, based on the total weight of the overcoating layer. Less than about 0.01 percent by weight has less effect in reducing the amount of metal acetyl acetonate employed in the overcoating. Amounts of charge transport materials in the overcoating of greater than about 10 percent by weight leads to surface blooming.

Any suitable insulating film forming binder having a very high dielectric strength and good electrically insulating properties may be used in the continuous charge transporting phase of the overcoating of this invention. The binder itself may be a charge transporting material or one capable of holding transport molecules in solid solution or as a molecular dispersion. Preferably, the film forming binder should have a glass transition temperature of at least about 80° C. because the copy machine operating environment does not adversely affect the binder at this temperature range. Typical film forming binder materials that are not charge transporting material include thermoplastic and thermosetting resins such as polycarbonates, polyesters, polymethacrylates, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, epoxides, cellulosic film formers, poly(amideimide), polychoro-styrene, poly (α-methylstyrene), polyvinylnaphthalene, polyvinyl ethers, polyvinyl alcohol, polyvinyl butyral, polyvinyl formal, polyvinyl carbazole, polyvinyl pyridine, polyvinylidene chloride, polyvinylidene fluoride, vinylidenechloride-vinylchloride copolymers, styrene-butadiene copolymers, vinylacetate-vinylidenechloride copolymers, styrene-alkyd resins, and the like. Any suitable film forming polymer having charge transport capabilities may be used as a binder in the overcoating of this invention. Binders having charge transport capabilities are substantially nonabsorbing in the spectral region of intended use, but are "active" in that they are capable of transporting charge carriers injected by the charge injection enabling particles in an applied electric field. The charge transport binder may be a hole transport film forming polymer or an electron transport film forming polymer. Charge transporting film forming polymers are well known in the art. A partial listing representative of such charge transporting film forming polymers includes the following: Polyvinylcarbazole and derivatives of Lewis acids described in U.S. Pat. No. 4,302,521. Vinyl-aromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717. Other transport materials such as poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as described in U.S. Pat. No. 3,870,516. The disclosures of each of the patents and pending patent applications identified above pertaining to binders having charge transport capabilities are incorporated herein in their entirety. The film forming binder should have an electrical resistivity at least about $10^{13}$ ohm-cm. It should be capable of forming a continuous film and be substantially transparent to activating radiation to which the underlying photoconductive layer is sensitive. In other words, the transmitted activating radiation should be capable of generating charge carriers, i.e. electron-hole pairs in the underlying photoconductive layer or layers. A transparency range of between about 10 percent and about 100 percent can provide satisfactory results depending upon the specific photoreceptors utilized. A transparency of at least about 50 percent is preferred for greater speed with optimum speeds being achieved at a transparency of at least 80 percent. Any suitable charge transport molecule capable of acting as a film forming binder or which is soluble or dispersible on a molecular scale in a film forming binder may be utilized in the continuous phase of the overcoating of this invention. The charge transport molecules may be hole transport molecules or electron transport molecules. Where the charge transport molecule is capable of acting as a film forming binder as indicated above, it may if desired, be employed to function as both as insulating binder for the metal acetyl acetonate and as the a charge transporting component without incorporating a different charge transport molecule in solid solution or as a molecular dispersion therein.

Charge transporting materials are well known in the art. In addition to the film forming polymers having charge transport capabilities listed above, a partial listing representative of non-film forming charge transporting materials include the following:

Diamine transport molecules of the types described in U.S. Pat. No. 4,306,008, U.S. Pat. No. 4,304,829, U.S. Pat. No. 4,233,384, U.S. Pat. No. 4,115,116, U.S. Pat. No. 4,299,897, U.S. Pat. No. 4,265,990 and U.S. Pat. No. 4,081,274. Typical diamine transport molecules include N,N'-diphenyl-N,N'-bis(alkylphenyl)-[1,1'-biphenyl]-4,4'-diamine wherein the alkyl is, for example, methyl, ethyl, propyl, n-butyl, etc. such as N,N'-diphenyl-N,N'-bis(3''-methylphenyl)-[1,1'-biphenyl]-4,4'-diamine, N,N'-diphenyl-N,N'-bis(4-methylphenyl)-[1,1'-biphenyl]-4,4'-diamine, N,N'-diphenyl-N, N'-bis(2-methylphenyl)-[1,1'-biphenyl]-4,4'-diamine, N,N'-diphenyl-N, N'-bis(3-ethylphenyl)-[1,1'-biphenyl]-4,4'-diamine, N,N'-diphenyl-N, N'-bis(4-ethylphenyl)-[1,1'-biphenyl]-4,4'-diamine, N,N'-diphenyl-N, N'-bis(4-n-butylphenyl)-[1,1'-biphenyl]-4,4'-diamine, N,N'-diphenyl-N, N'-bis(3-chlorophenyl)-[1,1'-biphenyl]-4,4'-diamine, N,N'-diphenyl-N, N'-bis(4-chlorophenyl)-[1,1'-biphenyl]-4,4'-diamine, N,N'-diphenyl-N, N'-bis(-phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N, N'-bis(4-methylphenyl)-[2,2'-dimethyl-1,1'-biphenyl]-4,4'-diamine, N,N'-diphenyl-N, N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like. Preferred diamine transport materials include those represented by the formula:

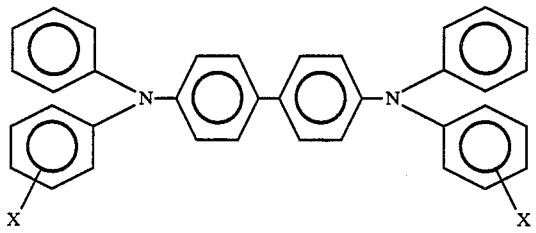

wherein X is selected from the group consisting of (ortho) $CH_3$, (meta) $CH_3$, (para) $CH_3$, (ortho) Cl, (meta) Cl, and (para) Cl. This transparent material is described, for example, in U.S. Pat. No. 4,265,990, the entire disclosure thereof being incorporated herein by reference.

Another preferred diamine transport material includes those represented by the formula:

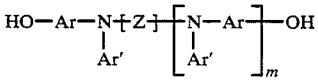

wherein:

m is 0 or 1,

Z is selected from the group consisting of:

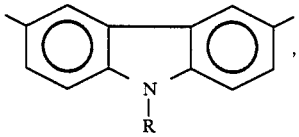

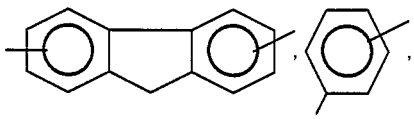

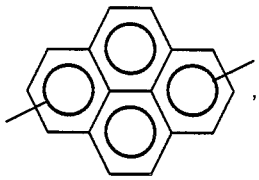

, and

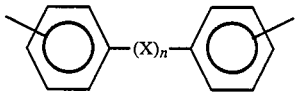

n is 0 or 1,

Ar is selected from the group consisting of:

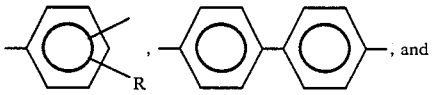

, and

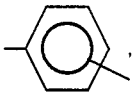

R is selected from the group consisting of $-CH_3$, $-C_2H_5$, $-C_3H_7$, and $-C_4H_9$, Ar' is selected from the group consisting of:

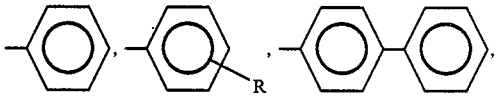

and

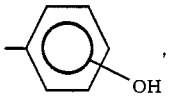

X is selected from the group consisting of:

$-CH_2-$, $-C(CH_3)_2-$, $-O-$, $-S-$,

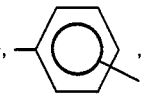

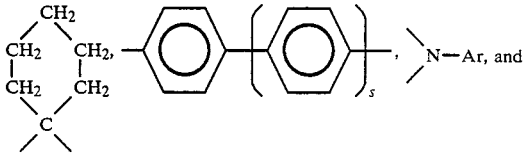

N—Ar, and

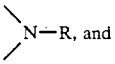

N—R, and s is 0, 1 or 2, the hydroxy arylamine compound being free of any direct conjugation between the —OH groups and the nearest nitrogen atom through one or more aromatic rings. The expression "direct conjugation" is defined as the presence of a segment having the formula:

$$-(C{=}C)_n-C{=}C-$$

where n=0 or 1 in one or more aromatic rings directly between an —OH group and the nearest nitrogen atom. Examples of direct conjugation between the —OH groups and the nearest nitrogen atom through one or more aromatic rings include a compound containing a phenylene group having an —OH group in the ortho or para position (or 2 or 4 position) on the phenylene group relative to a nitrogen atom attached to the phenylene group or a compound containing a polyphenylene group having an —OH group in the ortho or para position on the terminal phenylene group relative to a nitrogen atom attached to an associated phenylene group. Typical hydroxy arylamine compounds represented by the above formula include N,N'-diphenyl-N,N'-bis(3-hydroxyphenyl)-[1,1'-biphenyl]-4,4'-diamine;

N,N,N',N',-tetra(3-hydroxyphenyl)-[1,1'-biphenyl]-4,4'-diamine; N,N-di(3-hydroxyphenyl)-m-toluidine; 1,1-bis-[4-di-N,N-m-hydroxpyphenyl)-aminophenyl]-cyclohexane; 1,1-bis[4-(N-m-hydroxyphenyl)-4-(N-phenyl)-aminophenyl]-cyclohexane; Bis-(N-(3-hydroxyphenyl)-N-phenyl-4-aminophenyl)-methane; Bis[(N-(3-hydroxyphenyl)-N-phenyl)-4-aminophenyl]-isopropylidene; N,N'-diphenyl-N,N'-bis(3-hydroxyphenyl)-[1,1':4', 1''-terphenyl]-4,4''-diamine; 9-ethyl-3.6-bis[N-phenyl-N-3(3-hydroxyphenyl)-amino]-carbazole; 2,7-bis[N,N-di(3-hydroxyphenyl)-amino]-fluorene; 1,6-bis[N,N-di(3-hydroxyphenyl)-amino]-pyrene; and 1,4-bis[N-phenyl-N-(3-hydroxyphenyl)]-phenylenediamine. Typical hydroxyl arylamine compounds containing direct conjugation between the —OH groups and the nearest nitrogen atom through one or more aromatic rings include, for example: N,N'-diphenyl-N-N'-bis(4-hydroxyphenyl)[1,1'-biphenyl]-4,4'-diamine N,N,N'N',-tetra(4-hydroxyphenyl)-[1,1'-biphenyl]-4,4'-diamine; N,N-di(4-hydroxyphenyl)-m-toluidine; 1,1-bis-[4-(di-N,N-p-hydroxpyphenyl)-aminophenyl]-cyclohexane; 1,1-bis[4-(N-o-hydroxyphenyl)-4-(N-phenyl)-aminophenyl]-cyclohexane; Bis-(N-(4-hydroxyphenyl)-N-phenyl-4-aminophenyl)-methane; Bis[(N-(4-hydroxyphenyl)-N-phenyl)-4-aminophenyl]-isopropylidene; Bis-N,N-[(4'-hydroxy-4-(1,1'-biphenyl)]-aniline; and Bis-N,N-[(2'-hydroxy-4-(1,1'-biphenyl)]-aniline. These materials are described as useful as a component of photoreceptor overcoatings in U.S. patent application Ser. No. 07/198,254, filed May 24, 1988, a continuation in part application of U.S. patent application Ser. No. 07/061,247, filed June 10, 1987 now abandoned. The entire disclosure of U.S. patent application Ser. No. 07/198,254 is incorporated herein by reference. Pyrazoline transport molecules as disclosed in U.S. Pat. No. 4,315,982, U.S. Pat. No. 4,278,746, U.S. Pat. No. 3,837,851. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl) -5-(p-diethylaminophenyl)pyrazoline, 1-[6-methoxypyridyl -(2)]-3-(p-diethylaminostyryl)-5-(p-diethylaminophenyl)pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)-pyrazoline, and the like. Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene and the like. Oxadiazole transport molecules such as 2,5-bis(4-diethylaminophenyl)-1,3,4-oxadiazole, pyrazoline, imidazole, triazole, and others described in German Pat. Nos. 1,058,836, 1,060,260 and 1,120,875 and U.S. Pat. No. 3,895,944. Typical examples of hydrazone transport molecules include p-diethylaminobenzaldehyde -(diphenylhydrazone), o-ethoxy-p-diethylaminobenzaldehyde -(diphenylhydrazone), o-methyl-p-diethylaminobenzaldehyde -(diphenylhydrazone), o-methyl-p-dimethylaminobenzaldehyde -(dephenylhydrazone), p-dipropylaminobenzaldehyde -(diphenylhydrazone), p-diethylaminobenzaldehyde -(benzylphenylhydrazone), p-dibutylaminobenzaldehyde -(diphenylhydrazone), p-dimethylaminobenzaldehyde -(diphenylhydrazone) and the like described, for example in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene -1-carbaldehyde 1-methyl-1-phenylhydrazone and other hydrazone transport molecules are described, for example in U.S. Pat. No. 4,385,106, U.S. Pat. No. 4,338,388, U.S. Pat. No. 4,387,147, U.S. Pat. No. 4,399,208and U.S. Pat. No. 4,399,207. Another charge transport molecule is carbazole phenyl hydrazone. Typical examples of carbazole phenyl hydrazone transport molecules include 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, and 9-ethylcarbazole-3-carbaldehyde-1,1-diphenylhydrazone, and other suitable carbazole phenyl hydrazone transport molecules are described, for example, in U.S. Pat. No. 4,256,821. Similar hydrazone transport molecules are described, for example, in U.S. Pat. No. 4,297,426. Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described, for example, in U.S. Pat. No. 3,820,989. Typical 9-fluorenylidene methane derivative transport molecules include (4-n-butoxycarbonyl-9-fluorenylidene)-malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like. Other typical transport materials include the numerous transparent organic non-polymeric transport materials described in U.S. Pat. No. 3,870,516 and the nonionic compounds described in U.S. Pat. No. 4,346,157. The disclosures of each of the patents identified above pertaining to charge transport molecule which are soluble or dispersible on a molecular scale in a film forming binder are incorporated herein in their entirety. Other transport material such as poly-1-vinylpyrene, poly-9-vinylanthracene, poly-9-(4-pentenyl) -carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric or non-polymeric transport materials as described in U.S. Pat. No. 3,870,516. When the charge transport molecules are combined with an insulating film forming binder and metal acetyl acetonate, the amount of charge transport molecule which is used may vary depending upon the particular charge transport material and its compatibility (e.g. solubility in the insulating film forming binder component of the overcoating layer) and the like. Satisfactory results have been obtained using from between about 0.01 percent by weight and about 10 percent charge transport molecule based on the total weight of the overcoating layer. When overcoating layers are prepared with only insulating film forming binder and charge transport molecules in solid solution or molecular dispersion in the film forming binder, the overcoating layer remains insulating after charging until at least the image exposure step.

Minor amounts of plasticizers may also be added to the overcoating coating mixture to enhance the physical properties of the overcoating, particularly when thick coatings are formed. Examples of typical plasticizers include di-hydroxy-containing compounds such as polyethylene glycol, polypropylene glycol, glycoethers, and the like and neutral plasticizers such as polyesters, cellulose esters, cellulose ethers, and the like. Satisfactory results may be achieved when up to about 1 to 10 parts by weight of plasticizer, based on the total weight of the film forming polymer material, is added to the coating mixture prior to application to the electrophotographic imaging member. At high concentration of the metal acetyl acetonate, a plasticizer, such as low molecular weight species of the same film forming polymer, is desirable if the overcoating is applied on the surface of a selenium alloy having a low glass temperature, e.g. less than about 40° C.

The components of the overcoating layer may be mixed together by any suitable conventional means. Typical mixing means include stirring rods, ultrasonic vibrators, magnetic stirrers, paint shakers, sand mills, roll pebble mills, sonic mixers, melt mixing devices and the like. It is important, however, that the metal acetyl acetonate either dissolve in the insulating film forming binder or be capable of being molecularly dispersed in the insulating film forming binder. Also, if a charge transport material is utilized and if the insulating film forming binder is a different material than the charge transport molecules, the charge transport molecules must also either dissolve in the insulating film forming binder or be capable of being molecularly dispersed in the insulating film forming binder. Any suitable solvent or solvent mixture may be utilized to facilitate forming the desired coating film thickness. If desired, solvents may be added to the coating mixture to control the evaporation rate during the coating operation. If desired, a solvent or solvent mixture may be employed for the film forming binder, metal acetyl acetonate and any charge transport molecules. Preferably, the solvent or solvent mixture should dissolve both the insulating film forming binder and the metal acetyl acetonate as well as any charge transport molecules, if the later is used. The solvent selected should not adversely affect the underlying photoreceptor. For example, the solvent selected should not dissolve or crystallize the underlying photoreceptor.

The overcoating mixture may be applied by any suitable well known technique. Typical coating techniques include spraying, draw bar coating, dip coating, gravure coating, silk screening, air knife coating, reverse roll coating, extrusion techniques and the like. Any suitable conventional drying or curing technique may be utilized to dry the overcoating. The drying or curing conditions should be selected to avoid damaging the underlying photoreceptor. For example, the overcoating drying temperatures should not cause crystallization of amorphous selenium when an amorphous selenium photoreceptor is used. The thickness of the overcoating layer after drying or curing may be between about 0.3 micrometer and about 5 micrometers. Generally, overcoating thicknesses less than about 0.3 micrometer are difficult to apply but may probably be applied with the spraying techniques. Greater protection is provided by an overcoating thickness of at least about 3 micrometers. Lateral conductivity may be encountered causing deletion or defocused image problems when the overcoating thickness exceeds about 5 micrometers. Generally speaking, a thicker coating tends to wear better. The final dried or cured overcoating should be substantially insulating prior to charging. Satisfactory results may be achieved when the final overcoating has a resistivity at least about $10^{13}$ ohm-cm in the dark.

The final dried or cured overcoating should also be substantially non-absorbing in the spectral region at which the underlying photoconductive layer or layers are sensitive. The expression "substantially non-absorbing" is defined as a transparency of between about 10 percent and about 100 percent in the spectral region at which the underlying photoconductive layer or layers are sensitive. A transparency of at least about 50 percent in the spectral region at which the underlying photoconductive layer or layers are sensitive is preferred for greater speed with optimum speeds being achieved at a transparency of at least 80 percent.

The overcoating material of the present invention is applied to electrophotographic members as a thin coating having a thickness after cross-linking of from about 0.3 micrometer to about 5 micrometers. If the coating thickness is increased above about 5 micrometers, lateral conductivity may be encountered causing deletion or defocused image problems. Thicknesses less than about 0.3 micrometer are difficult to apply but may probably be applied with the spraying techniques. Generally speaking, a thicker coating tends to wear better. These coatings also protect the photoreceptor from varying atmospheric conditions and can even tolerate contact with human hands.

Any suitable electrophotographic imaging member may be coated with the process of the invention. The electrophotographic imaging members may contain inorganic or organic photoresponsive materials in one or more layers. Typical photoresponsive materials include selenium, selenium alloys, such as arsenic selenium and tellurium selenium alloys, halogen doped selenium, and halogen doped selenium alloys. Typical multi-layered photoresponsive devices include those described in US-A 4,251,612, which device comprising an electrically conductive substrate, overcoated with a layer capable of injecting holes into a layer on its surface, this layer comprising carbon black or graphite dispersed in the polymer, a hole transport layer in operative contact with the layer of hole injecting material, overcoated with a layer of charge generating material comprising inorganic or organic photoconductive materials, this layer being in contact with a charge transport layer, and a top layer of an insulating organic resin overlying the layer of charge generating layer. Other organic photoresponsive devices embraced within the scope of the present invention include those comprising a substrate, a generating layer such as trigonal selenium or vanadyl phthalocyanine in a binder, and a transport layer such as those described in US-A 4,265,990. Still other organic photoresponsive devices include those comprising a substrate, a transport layer, and a generating layer.

The electrophotographic imaging member may be of any suitable configuration. Typical configurations include sheets, webs, flexible or rigid cylinders, and the like. Generally, the electrophotographic imaging members comprise a supporting substrate which may be electrically insulating, electrically conductive, opaque or substantially transparent. If the substrate is electrically insulating, an electrically conductive layer is usually applied to the substrate. The conductive substrate or conductive layer may comprise any suitable material such as aluminum, nickel, brass, conductive particles in a binder, and the like. For flexible substrates, one may utilize any suitable conventional substrate such as aluminized Mylar. Depending upon the degree of flexibility desired, the substrate layer may be of any desired thickness. A typical thickness for a flexible substrate is from about 3 mils to about 10 mils.

Generally, electrophotographic imaging members comprise one or more additional layers on the conductive substrate or conductive layer. For example, depending upon flexibility requirements and adhesive properties of subsequent layers, one may utilize an adhesive layer. Adhesive layers are well known and examples of typical adhesive layers are described in US-A 4,265,990.

One or more additional layers may be applied to the conductive or adhesive layer. When one desires a hole injecting conductive layer coated on a substrate, any suitable material capable of injecting charge carriers under the influence of an electric field may be utilized. Typical of such materials include gold, graphite or carbon black. Generally, the carbon black or graphite dispersed in the resin are employed. This conductive layer may be prepared, for example, by solution casting of a mixture of carbon black or graphite dispersed in an adhesive polymer solution onto a support substrate such as Mylar or aluminized Mylar. Typical examples of resins for dispersing carbon black or graphite include polyesters such as PE 100 commercially available from Goodyear Tire & Rubber Company, polymeric esterification products of a dicarboxylic acid and a diol comprising a diphenol, such as 2,2-bis(3-beta-hydroxyethoxy phenyl) propane, 2,2-bis(4-hydroxyisopropoxyphenyl)propane, 2,2-bis(4-beta hydroxy ethoxy phenyl)pentane and the like and a dicarboxylic acid such as oxalic acid, malonic acid, succinic acid, phthalic acid, terephthalic acid, and the like. The weight ratio of polymer to carbon black or graphite may range from about 0.5:1 to 2:1 with the preferred range being about 6:5. The hole injecting layer may have a thickness in the range of from about 1 micron to about 20 micrometers, and preferably from about 4 micrometers to about 10 micrometers.

A charge carrier transport layer may be overcoated on the hole injecting layer and may be selected from numerous suitable materials capable of transporting holes. The charge transport layer generally has a thickness in the range of from about 5 about 50 micrometers and preferably from about 20 to about 40 micrometers. A charge carrier transport layer preferably comprises molecules of the formula:

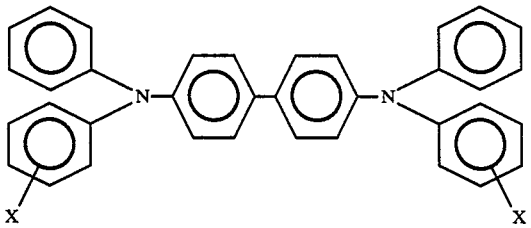

dispersed in a highly insulating and transparent organic resinous material wherein X is selected from the group consisting of (ortho) $CH_3$, (meta) $CH_3$, (para) $CH_3$, (ortho) Cl, (meta) Cl, and (para) Cl. The charge transport layer is substantially non-absorbing in the spectral region of intended use, e.g., visible light, but is "active" in that it allows injection of photogenerated holes from the charge generator layer and electrically induced holes from the injecting surface. A highly insulating resin, having a resistivity of at least about $10^{12}$ ohm-cm to prevent undue dark decay will not necessarily be capable of supporting the injection of holes from the injecting generating layer and is not normally capable of allowing the transport of these holes through the resin. However, the resin becomes electrically active when it contains from about 10 to about 75 weight percent of, for example, N,N,N',N'-tetraphenyl-[1,1'-biphenyl]-4,4'-diamine corresponding to the structural formula above. Other materials corresponding to this formula include, for examples, N,N'-diphenyl-N,N'-bis-(alkylphenyl)-[1,1'-biphenyl]-4,4'-diamine wherein the alkyl group is selected from the group consisting of methyl such as 2-methyl, 3-methyl and 4-methyl, ethyl, propyl, butyl, hexyl, and the like. In the case of chloro substitution, the compound may be N,N'-diphenyl-N,N'-bis(halophenyl)-[1,1'-biphenyl]-4,4'-diamine wherein the halo atom is 2-chloro, 3-chloro or 4-chloro.

Other electrically active small molecules which can be dispersed in the electrically inactive resin to form a layer which will transport holes includes triphenylmethane, bis(4-diethylamino-2-methylphenyl) phenylmethane, 4',4''-bis(diethylamino)-2',2''-dimethyltriphenylmethane, bis4(diethylaminophenyl)phenylmethane, and 4,4'-bis(diethylamino)-2',2''-dimethyltriphenylmethane.

The generating layer that may be utilized, in addition to those disclosed herein, can include, for example, pyrylium dyes, and numerous other photoconductive charge carrier generating materials provided that these materials are electrically compatible with the charge carrier transport layer, that is, they can inject photoexcited charge carriers into the transport layer and the charge carriers can travel in both directions across the interface between the two layers. Particularly useful inorganic photoconductive charge generating material include amorphous selenium, trigonal selenium, selenium-arsenic alloys and selenium-tellurium alloys and organic charge carrier generating materials including the X-form of phthalocyanine, metal phthalocyanines and vanadyl phthalocyanines. These materials can be used alone or as a dispersion in a polymeric binder. This layer is typically from about 0.5 to about 10 micrometers or more in thickness. Generally, the thickness of the layer should be sufficient to absorb at least about 90 percent or more of the incident radiation which is directed upon it in the imagewise exposure step. The maximum thickness is dependent primarily upon mechanical considerations such as whether a flexible photoreceptor is desired.

The electrophotographic imaging member can be imaged by the conventional steps of uniformly depositing an electrostatic charge and exposing to an imagewise pattern of electromagnetic radiation to which the charge carrier generating layer is responsive to form an electrostatic latent image on the electrophotographic imaging member. The electrostatic latent image formed may then be developed by conventional means resulting in a visible image. Conventional development techniques such as cascade development, magnetic brush development, liquid development, and the like may be utilized. The visible image is typically transferred to a receiving member by conventional transfer techniques and permanently affixed to the receiving member.

The overcoating of this invention reduces residual potential build up during cycling, maintains the transparency of overcoatings and enhances the adhesion of the overcoating layer to the underlying electrophotographic imaging layer. Moreover, the overcoating layer of this invention reduces residual potential build up during cycling without substantial lateral conductivity.

The invention will now be described in detail with respect to specific preferred embodiments thereof, it being understood that these embodiments are intended to be illustrative only and that the invention is not intended to be limited to the specific materials, conditions, process parameters and the like recited herein. Parts and percentages are by weight unless otherwise indicated.

EXAMPLES Ia through If

A photoreceptor was prepared comprising a flat aluminum substrate having a width of 8 inches (20.3 cm) length of 10 inches (25.4 cm) coated with a vacuum-deposited first selenium alloy layer having a thickness of about 55 micrometers and containing about 99.5 percent by weight selenium, about 0.5 percent by weight arsenic and about 20 parts per million chlorine and a vacuum deposited second outer layer having a thickness of about 5 micrometers and containing about 90 percent by weight selenium and about 10 percent by weight tellurium. An overcoating composition was then prepared comprising about 2.5 grams of polycarbonate-copolyester (GE-3250, available from General Electric Co.) in a solvent mixture of 28.5/19 grams methylene chloride/1,1,2-trichloroethane (weight ratio 6:4). The solution (5 percent by weight solids) was agitated with a wrist-arm shaker for 120 minutes. The solution was then used to coat the selenium photoreceptor plate using a Bird drawbar [6 inches (15.2 cm) long and 0.5 mil (12.7 micrometers) wire]. The coating was then dried at 45° C. for 60 minutes, and then at room temperature overnight to form a coating having a thickness of about 1.25 micrometers.

The foregoing procedures were repeated for five additional runs (runs Ib through If) with the same materials except that zirconium acetyl acetonate was added with increasingly larger amounts of zirconium acetyl acetonate being added for each additional run and with corresponding decreasing amounts of polymer so that the total percent by weight solids in the coating mixture remained at 5 percent for every run. Thus, for example, in fun If the amount of polymer employed was 1.25 grams, the amount of zirconium acetyl acetonate selected was 1.25 grams (weight ratio 1:1). The relative amounts of polymer and zirconium acetyl acetonate in the runs la through If as well as the corresponding dried overcoating thicknesses are summarized in Tables I through III below.

EXAMPLES IIa and IIb

The procedures described in Examples Ia and If were repeated with a fresh selenium alloy photoreceptor, but with polycarbonate resin (Markrolon 5705, available from Larbensabricken Bayer A.G.) substituted for the polycarbonate-copolyester resin.

EXAMPLES IIIa and IIIb

The procedures described in Examples Ia and If were repeated with a fresh selenium alloy photoreceptor, but with polymethyl methacrylate resin substituted for the polycarbonate-copolyester resin.

EXAMPLES IVa and IVb

The procedures described in Examples Ia and If were repeated with a fresh selenium alloy photoreceptor, but with polysulfone resin (Udel P-1800, available from Union Carbide Corp.) substituted for the polycarbonate-copolyester resin.

EXAMPLES Va and Vb

The procedures described in Examples Ia and If were repeated with a fresh selenium alloy photoreceptor, but with polyimide resin (Ultem, available from General Electric Co.) substituted for the polycarbonate-copolyester resin.

EXAMPLES VIa and VIb

The procedures described in Examples Ia and If were repeated with a fresh selenium alloy photoreceptor, but with polyester resin (Vitel PE-100, available from Goodyear Tire & Rubber Co.) substituted for the polycarbonate-copolyester resin.

EXAMPLES VIIa and VIIb

The procedures described in Examples Ia and If were repeated with a fresh selenium alloy photoreceptor, but with polyacrylate resin (Ardel D-100, available from Union Carbide Corp.) substituted for the polycarbonate-copolyester resin.

EXAMPLE VIII

A photoreceptor was prepared comprising a flat aluminum substrate having a width of 8 inches (20.3 cm) length of 10 inches (25.4 cm) coated with a vacuum deposited first selenium alloy layer having a thickness of about 55 micrometers and containing about 99.5 percent by weight selenium, about 0.5 percent by weight arsenic and about 20 parts per million chlorine and a vacuum deposited second outer layer having a thickness of about 5 micrometers and containing about 90 percent by weight selenium and about 10 percent by weight tellurium. An overcoating composition was then prepared comprising about 1.25 grams of polycarbonate-copolyester (GE-3250, available from General Electric Co.), about 1.25 grams of zirconium acetyl acetonate and about 0.63 grams (weight ratio 2:1::1) N,N'-diphenyl-N,N'-bis(3-methylphenyl)-(1,1'-biphenyl) -4,4'-diamine in a solvent mixture of about 29.5/19 grams containing methylene chloride/1,1,2-trichloroethane (weight ratio 6:4). The solution [5 percent by weight solids (polymer+zirconium acetyl acetonate)]was agitated with a wrist-arm shaker for 120 minutes. The solution was then used to coat the selenium photoreceptor plate using a Bird drawbar [6 inches (15.2 cm) long and 0.5 mil (12.7 micrometers) wire]. The coating was then dried at 45° C. for 60 minutes, and then at room temperature overnight to form a coating having a thickness of about 1.1 micrometer.

EXAMPLES IX

The procedures described in Example VIII were repeated with a fresh selenium alloy photoreceptor, but with polyimide resin (Ultem, available from General Electric Co.) substituted for the polycarbonate-copolyester resin.

EXAMPLES X

The dried, coated photoreceptors prepared as described in Examples Ia through IXb were subjected to electrical, adhesion, abrasion resistance, solvent resistance and print tests. An electrical test determined the charging level, dark decay, and the residual potential. An adhesion test utilized an adhesive tape (cellophane based 3M-600 tape) which was applied on the coated photoreceptor and thereafter peeled off. An abrasion test involved scratching the surface with sharpened pencils of various hardnesses. A solvent resistance test involved contacting the overcoating surface with cotton soaked with isopropyl alcohol. The results of these test are set forth in TABLES I and II below:

TABLE I

Physical properties of the Overcoated Selenium Plates

| Exp. No. | Polymer | $Zr(AcAc)_4$ % based on polymer | Thickness (μ) | Solvent Resistance (IPA) | Adhesion (Tape Test) (3M-600) | Hardness (Pencil) | Transparency |
|---|---|---|---|---|---|---|---|
| Ia | Poly(carbonate ester), GE-3250 | 0 | 1.25 | P | P | 4 H | + |
| Ib | Poly(carbonate ester), GE-3250 | 20 | 1.0 | P | P | 6 H | + |
| Ic | Poly(carbonate ester), GE-3250 | 40 | 1.0 | P | P | 6 H | + |
| Id | Poly(carbonate ester), GE-3250 | 60 | 0.8 | P | P | 4 H | + |
| Ie | Poly(carbonate ester), GE-3250 | 80 | 0.8 | P | P | 8 H | + |
| If | Poly(carbonate ester), GE-3250 | 100 | 1.3 | P | P | 6 H | + |
| IIa | Polycarbonate Makrolon 5705 | 0 | 0.6 | P | P | 6 H | + |
| IIb | Polycarbon ate Makrolon 5705 | 100 | 0.7 | P | P | 6 H | + |
| IIIa | Polymethyl methacrylate | 0 | 1.3 | P | P | 6 H | − |
| IIIb | Polymethyl methacrylate | 100 | 0.9 | F | P | 6 H | − |
| IVa | Polysulfone Udel P-1800 | 0 | 1.3 | P | P | 7 H | + |
| IVb | Polysulfone Udel P-1800 | 100 | 2.6 | P | P | 4 H | − |
| Va | Polyimide GE Ultem | 0 | 1.2 | P | P | 7 H | + |
| Vb | Polyimide GE Ultem | 100 | 1.2 | P | P | 5 H | + |
| VIa | Polyester Goodyear Vitel PE-100 | 0 | 0.9 | P | F | 4 H | + |
| VIb | Polyester Goodyear Vitel PE-100 | 100 | 0.6 | P. | P | 5 H | + |
| VIIa | Polyarylate Union Carbide Ardel D-100 | 0 | 1.0 | P | P | 7 H | + |
| VIIb | Polyarylate Union Carbide Ardel D-100 | 100 | 2.0 | P | P | 4 H | − |
| VIII | Poly(carbonate co-ester) GE-3250 (w/Diamine) | 100 | 1.1 | P | P | 4 H | + |
| IX | Polyimide GE Ultem (w/Diamine) | 100 | 1.1 | F | F | 6 H | + |

Key to notations: P = passed; F = failed; + = transparent; − = not transparent.
The pencil hardness number is that of a pencil which did not scratch the film.

TABLE II

ELECTRICAL Properties of the Overcoated Selenium Plates

| Exp. No. | Polymer | $Zr(AcAc)_4$ % based on polymer | Thickness (μ) | Corotron (+KV) | Charge (Level (+V) | Dark Decay (V/sec) | Residual Potential ($V_R$) | Residual Potential ($V_R/\mu$) |
|---|---|---|---|---|---|---|---|---|
| Ia | Poly(carbonate ester), GE-3250 | 0 | 1.25 | 4.9 | 970 | 5 | 230 | 180 |
| Ib | Poly(carbonate ester), GE-3250 | 20 | 1.0 | 4.9 | 930 | 5 | 105 | 105 |
| Ic | Poly(carbonate ester), GE-3250 | 40 | 1.0 | 4.9 | 930 | 5 | 120 | 120 |
| Id | Poly(carbonate ester), GE-3250 | 60 | 0.8 | 4.9 | 990 | 5 | 70 | 88 |
| Ie | Poly(carbonate ester), GE-3250 | 80 | 0.8 | 5.0 | 870 | 5 | 45 | 56 |
| If | Poly(carbonate ester), GE-3250 | 100 | 1.3 | 5.0 | 970 | 10 | 20 | 15 |
| IIa | Polycarbonate Makrolon 5705 | 0 | 0.6 | 5.0 | 930 | 0 | 340 | 570 |
| IIb | Polycarbonate Makrolon 5705 | 100 | 0.7 | 5.0 | 980 | 5 | 80 | 110 |
| IIIa | Polymerthylmethacrylate | 0 | 1.3 | 5.0 | 880 | 10 | 260 | 200 |
| IIIb | Polymerthylmethacrylate | 100 | 0.9 | 5.0 | 940 | 10 | 80 | 90 |
| IVa | Polysulfone Udel P-1800 | 0 | 1.3 | 5.0 | 980 | 8 | 360 | 280 |
| IVb | Polysulfone Udel P-1800 | 100 | 2.6 | 4.9 | 960 | 15 | 100 | 38 |
| Va | Polyimide GE Ultem | 0 | 1.2 | 4.8 | 970 | 0 | 320 | 266 |
| Vb | Polyimide GE Ultem | 100 | 1.2 | 4.8 | 920 | 5 | 20 | 17 |
| VIa | Polyester Goodyear Vitel PE-100 | 0 | 0.9 | 4.9 | 960 | 10 | 20 | 244 |
| VIB | Polyester Goodyear Vitel PE-100 | 100 | 0.6 | 5.0 | 960 | 10 | 60 | 100 |
| VIIa | Polyarylate Union Carbide Ardel D-100 | 0 | 1.0 | 5.0 | 990 | 5 | 130 | 130 |
| VIIb | Polyarylate Union Carbide Ardel D-100 | 100 | 2.0 | 4.9 | 960 | 5 | 150 | 75 |
| VIII | Poly(carbonate co-ester), GE-3250 (w/Diamine) | 100 | 1.1 | 5.0 | 970 | 10 | 20 | 73 |
| IX | Polyimide GE Ultem (w/Diamine) | 100 | 1.1 | 4.8 | 910 | 5 | 15 | 14 |

The test results in the Tables above clearly show that (1) the charging level is not affected by the amount of the metal acetyl acetonate; (2) the dark decay is rather unaffected, and (3) the most important results is the lowering of the residual potential by the addition of the metal acetyl acetonate. Residual Voltage ($V_R$) decreased as the metal acetyl acetonate content increased. It was surprising to see $V_R$ decrease without significantly affecting dark conductivity, e.g., the dark decay.

EXAMPLES XII

The overcoated photoreceptors of Examples Ia through If were tested in a Xerox Model D flat plate xerographic machine using conventional xerographic imaging steps comprising uniform charging, exposure to a test pattern to form an electrostatic latent image corresponding to the test pattern, development with a two component developer to form a toner image corresponding to the electrostatic latent image, electrostatically transferring the toner image to a sheet of paper and cleaning the overcoated photoreceptor. Imaging for the first set of images was conducted in a controlled environment in which the relative humidity was maintained at 10 percent and temperature was maintained at −12° C. Imaging for the second set of images was conducted in a controlled environment in which the relative humidity was maintained at 80 percent and temperature was maintained at +27° C. The results of resolution tests performed on the transferred toner images at high and low humidities and temperatures on the overcoated photoreceptors described in Examples Ia through If are set forth in TABLE III below:

TABLE III

| Exp. No. | Polymer | Physical properties of the Overcoated Selenium Plates: $Zr(AcAc)_4$ % based on polymer | Thickness (μ) | Resolution (Horizontal/Vertical) 10% RH & −12° C.) | Resolution (Horizontal/Vertical) 80% RH & +27° C. |
|---|---|---|---|---|---|
| Ia | Poly(carbonate ester), GE-3250 | 0 | 1.25 | 1.0/1.5 | 1.0/1.5 |
| Ib | Poly(carbonate ester), GE-3250 | 20 | 1.0 | 6/7 | 6/7 |
| Ic | Poly(carbonate ester), GE-3250 | 40 | 1.0 | 6/7 | 6/7 |
| Id | Poly(carbonate ester), GE-3250 | 60 | 0.8 | 6/7 | 6/7 |
| Ie | Poly(carbonate ester), GE-3250 | 80 | 0.8 | 4.5/5 | 4.3/5 |
| If | Poly(carbonate ester), GE-3250 | 100 | 1.3 | 4.5/5 | 6/4 |

As demonstrated in Table III, the addition of the zirconium acetyl acetonate complex enhanced the resolution in Examples Ib, Ic, Id, Ie, and If, from 1.0/1.5 of the control to as high as 6/7, even at high relative humidity. This is normally not what one would expect from an overcoating. Moreover, the resolution of the print was improved at low relative humidity. In general, an increase in humidity results in a decrease in resolution for most prior art overcoatings. Also, the addition of zirconium acetyl acetonate at the highest concentration (1:1, or 100 percent based on the weight of polymer) in Example If did not cause any lateral conductivity or deletion of print at high relative humidity. This further indicates that the lowering of residual potential is not ionic in nature and that the excellent electrical results throughout were unexpected.

The invention has been described in detail with particular reference to preferred embodiments thereof and it will be understood that variations and modifications can be effected within the spirit and scope of the invention as described hereinabove, and as defined in the appended claims.

What is claimed is:

1. An electrophotographic imaging member comprising a supporting substrate, at least one photoconductive layer and an overcoating layer having one side contiguous with said electrophotographic imaging layer and the other side exposed to the ambient atmosphere, said overcoating layer comprising a solid solution or molecular dispersion of a metal acetyl acetonate in an insulating film forming polymer.

2. An electrophotographic imaging member according to claim 1 wherein said overcoating layer also comprises a dissolved or molecularly dispersed charge transport material.

3. An electrophotographic imaging member according to claim 2 wherein said overcoating layer comprises between about 0.01 percent by weight and about 10 percent by weight of said charge transport material, based on the total weight of said overcoating layer.

4. An electrophotographic imaging member according to claim 1 wherein said overcoating comprises between about 5 percent by weight and about 50 percent by weight of said metal acetyl acetonate, based on the total weight of said overcoating layer.

5. An electrophotographic imaging member according to claim 1 wherein said overcoating layer has a thickness of between about 0.3 micrometer and about 5 micrometers.

6. An electrophotographic imaging member according to claim 1 wherein said photoconductive layer comprises a charge generating layer and a charge transport layer.

7. An electrophotographic imaging member according to claim 1 wherein said photoconductive layer comprises a mixture of photoconductive particles dispersed in a film forming resin matrix.

8. An electrophotographic imaging member according to claim 1 wherein said film forming polymer has a glass transition temperature of at least about 80° C.

9. An electrophotographic imaging member according to claim 1 wherein said photoconductive layer comprises an amorphous selenium layer.

10. An electrophotographic imaging member according to claim 1 wherein said overcoating layer overlies a selenium alloy layer of an electrophotographic imaging member.

11. An electrophotographic imaging member according to claim 1 wherein said overcoating layer is contiguous to a charge transport layer of an electrophotographic imaging member.

12. An electrophotographic imaging member according to claim 1 wherein said overcoating layer also comprises a dissolved charge transport material having the formula:

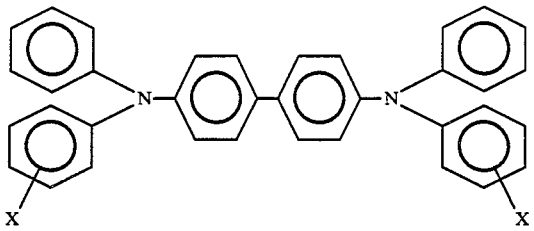

wherein X is selected from the group consisting of $CH_3$ and Cl.

13. An electrophotographic imaging member according to claim 1 wherein said overcoating layer also comprises a dissolved charge transport material having the formula:

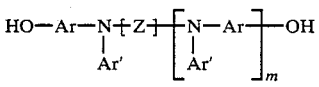

wherein:

m is 0 or 1,

Z is selected from the group consisting of:

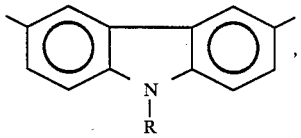

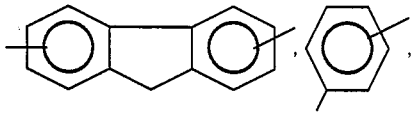

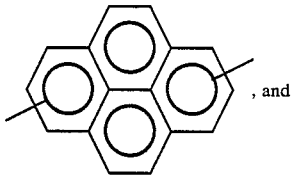

, and

-continued

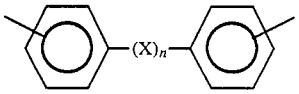

n is 0 or 1,

Ar is selected from the group consisting of:

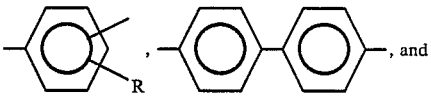

, and

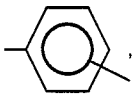

R is selected from the group consisting of $-CH_3$, $-C_2H_5$, $-C_3H_7$, and $-C_4H_9$, Ar'is selected from the group consisting of:

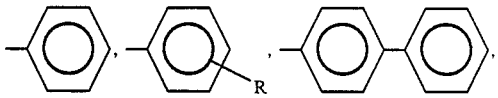

and

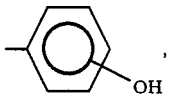

X is selected from the group consisting of:

$-CH_2-$, $-C(CH_3)_2-$, $-O-$, $-S-$,

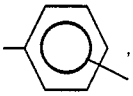

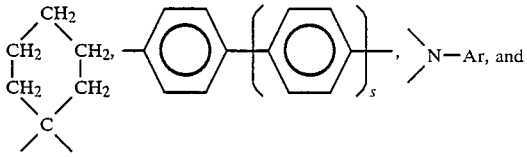

N—Ar, and

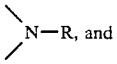

N—R, and s is 0, 1 or 2, said hydroxy arylamine compound being free of any direct conjugation between the —OH groups and the nearest nitrogen atom through one or more aromatic rings.

* * * * *